US008585558B2

(12) United States Patent
Chen

(10) Patent No.: US 8,585,558 B2
(45) Date of Patent: Nov. 19, 2013

(54) TRAMPOLINE GAME

(76) Inventor: Samuel Chen, Shanghai (CN)

( * ) Notice: Subject to any disclaimer, the term of this patent is extended or adjusted under 35 U.S.C. 154(b) by 73 days.

(21) Appl. No.: 13/237,252

(22) Filed: Sep. 20, 2011

(65) Prior Publication Data

US 2013/0072269 A1 Mar. 21, 2013

(51) Int. Cl.
*A63B 5/11* (2006.01)

(52) U.S. Cl.
USPC ..... 482/27; 482/28; 482/29

(58) Field of Classification Search
None
See application file for complete search history.

(56) References Cited

U.S. PATENT DOCUMENTS

| | | | | |
|---|---|---|---|---|
| 5,785,592 | A * | 7/1998 | Jacobsen | 463/7 |
| 5,904,621 | A * | 5/1999 | Small et al. | 463/52 |
| 7,632,187 | B1 * | 12/2009 | Farley et al. | 463/53 |
| 2005/0209053 | A1 * | 9/2005 | Knox | 482/27 |
| 2006/0135321 | A1 * | 6/2006 | Chen | 482/27 |
| 2006/0270525 | A1 * | 11/2006 | Colling | 482/27 |
| 2008/0269019 | A1 * | 10/2008 | Lovley, II | 482/27 |
| 2008/0269020 | A1 * | 10/2008 | Alexander | 482/29 |
| 2008/0269021 | A1 * | 10/2008 | Publicover | 482/29 |
| 2011/0034300 | A1 | 2/2011 | Hall | |

FOREIGN PATENT DOCUMENTS

WO PCT/DE90/00713 4/1991

OTHER PUBLICATIONS http://web.archive.org/web/20090627092733/http://www.thebouncehouseac.com/laser-tag.html.*
BouncePro by SportsPower, 15FT Steel Flex Enclosure with Electron Shooter, User's Manual TR1806-FLEX-ENC, pp. 1-20.*

* cited by examiner

*Primary Examiner* — David L Lewis
*Assistant Examiner* — Shauna-Kay Hall
(74) *Attorney, Agent, or Firm* — Clement Cheng

(57) ABSTRACT

A trampoline game has a trampoline with a trampoline frame and a trampoline bed. The trampoline bed is connected to the trampoline frame by a plurality of springs. A gun has an infrared emitter emitting an infrared signal. A target has one or more infrared receivers capable of receiving a signal from the infrared emitter of the gun. A second gun also has an infrared emitter emitting an infrared signal, and the target is capable of receiving an infrared signal from the second gun. A bounce sensor can be used for sensing user bounces. The bounce sensor outputs data which could be sent to a microprocessor. Defined game parameters may be stored in memory programmed into a microprocessor that receives data.

19 Claims, 6 Drawing Sheets

TRAMPOLINE GAME

FIELD OF THE INVENTION

The present invention is in the field of trampoline games.

DISCUSSION OF RELATED ART

A variety of trampoline games have been played on trampolines, such as basketball. Publicover describes a trampoline game accessory in United States publication 20050043122 published Feb. 24, 2005, the disclosure of which is incorporated herein by reference. The trampoline game includes a variety of electronic buttons located above a trampoline bed. Publicover in United States publication 20100190608 of Jul. 29, 2000 and describes a trampoline game system with additional optional accessories including variations of tag, hopscotch, volleyball, basketball and other modifications of traditional games which may include scoring a goal with a ball. Colling in U.S. Pat. No. 7,481,740 issued Jan. 27, 2009 includes a soccer goal fitted on a portion of a trampoline enclosure net. Other devices such as Chen in U.S. Pat. No. 6,918,846 provides for an inflatable basketball structure which can also be used for enclosing a trampoline structure.

SUMMARY OF THE INVENTION

A trampoline game has a trampoline with a trampoline frame and a trampoline bed. The trampoline bed is connected to the trampoline frame by a plurality of springs. A gun has an infrared emitter emitting an infrared signal. A target has one or more infrared receivers capable of receiving a signal from the infrared emitter of the gun.

A second gun also has an infrared emitter emitting an infrared signal, and the target is capable of receiving an infrared signal from the second gun. A bounce sensor can be used for sensing user bounces. The bounce sensor outputs data which could be sent to a microprocessor. Defined game parameters may be stored in memory programmed into a microprocessor that receives data. A boss target game parameter and underling target game parameters may also be included so that the boss target has greater hit points than underling targets making the boss more challenging.

A game level game parameter can be defined as a round requiring a complete deactivation of every target. Player attribute game parameters may include a gun cooldown time defined as a set delay time that the gun requires before a successive shot is initiated. Player attribute game parameters could also include a gun ammunition capacity defined as the number of shots that the gun stores such that when the gun ammunition reaches zero the gun can no longer hit targets. Player attribute game parameters may also include player hit points defined as a certain number of hit points required to eliminate the player. Player attribute game parameters could also include a charge per bounce defined as the number of bounces required to load a shot of ammunition to allow the gun to fire a single shot. The bounce sensor senses the bounces and sends bounce signals to the microprocessor. The microprocessor increments the shot of ammunition. A hit point visual indicator can be located on the target implemented by LED lighting.

Additionally, the bounce sensor could be used for cycling the active target, or cycling different locations of vulnerable areas on various active targets. The bounce sensor could also be used for cycling or changing other game parameters. The bounce sensor could be used for toggling different sound or visual effects related to the game as well as for toggling player attributes or target attributes.

Figure 1:
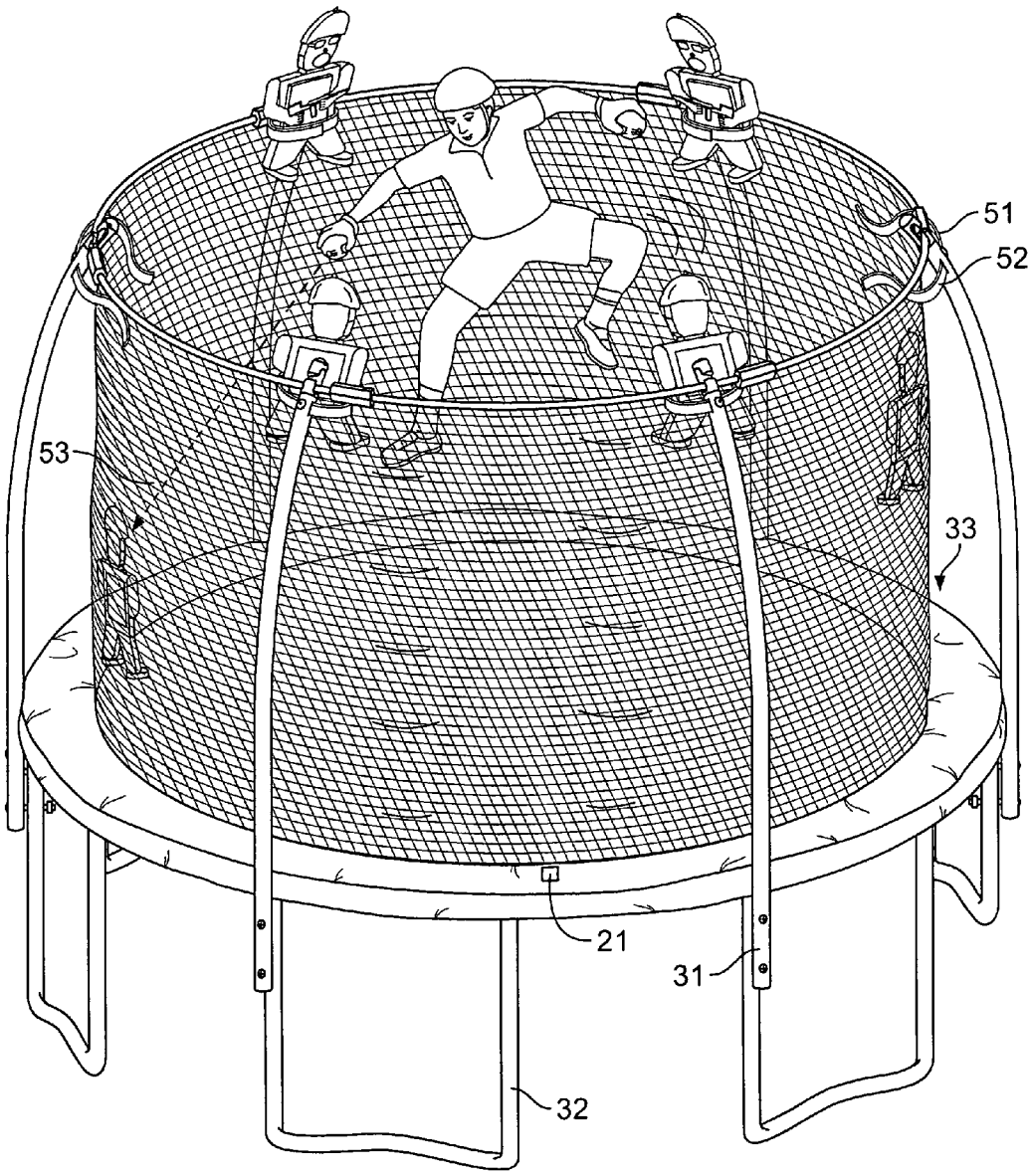
FIG. 1 is a diagram of a user playing the trampoline game.
Figure 2:
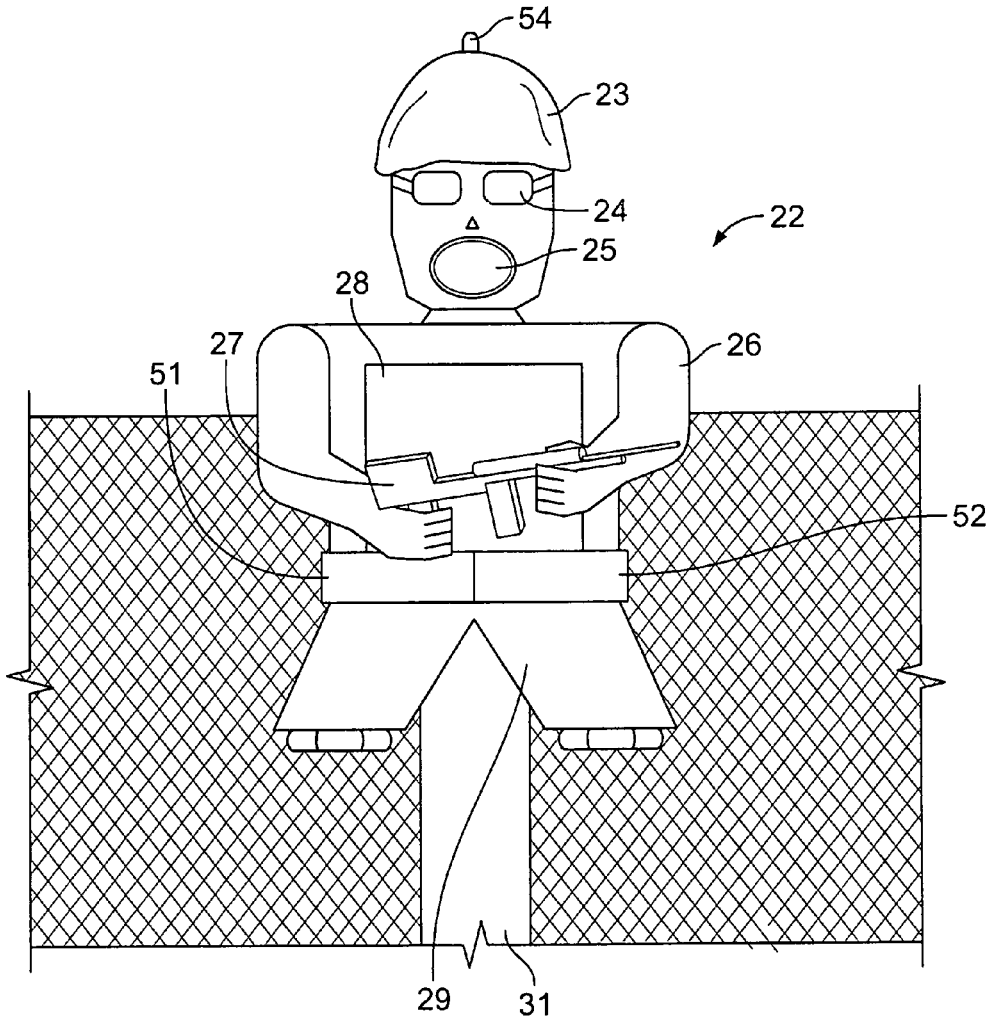
FIG. 2 is a diagram of a target.
Figure 3:
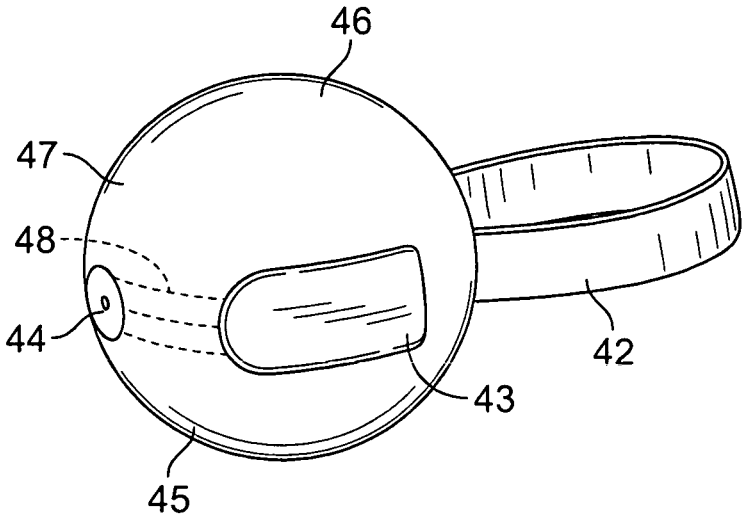
FIG. 3 is a diagram of the first gun used for shooting the target.
Figure 4:
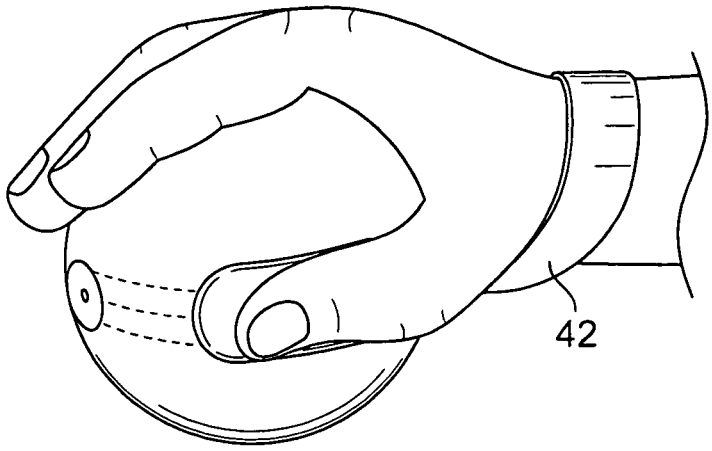
FIG. 4 is a diagram of the second gun as held by a user for shooting the target.
Figure 5:
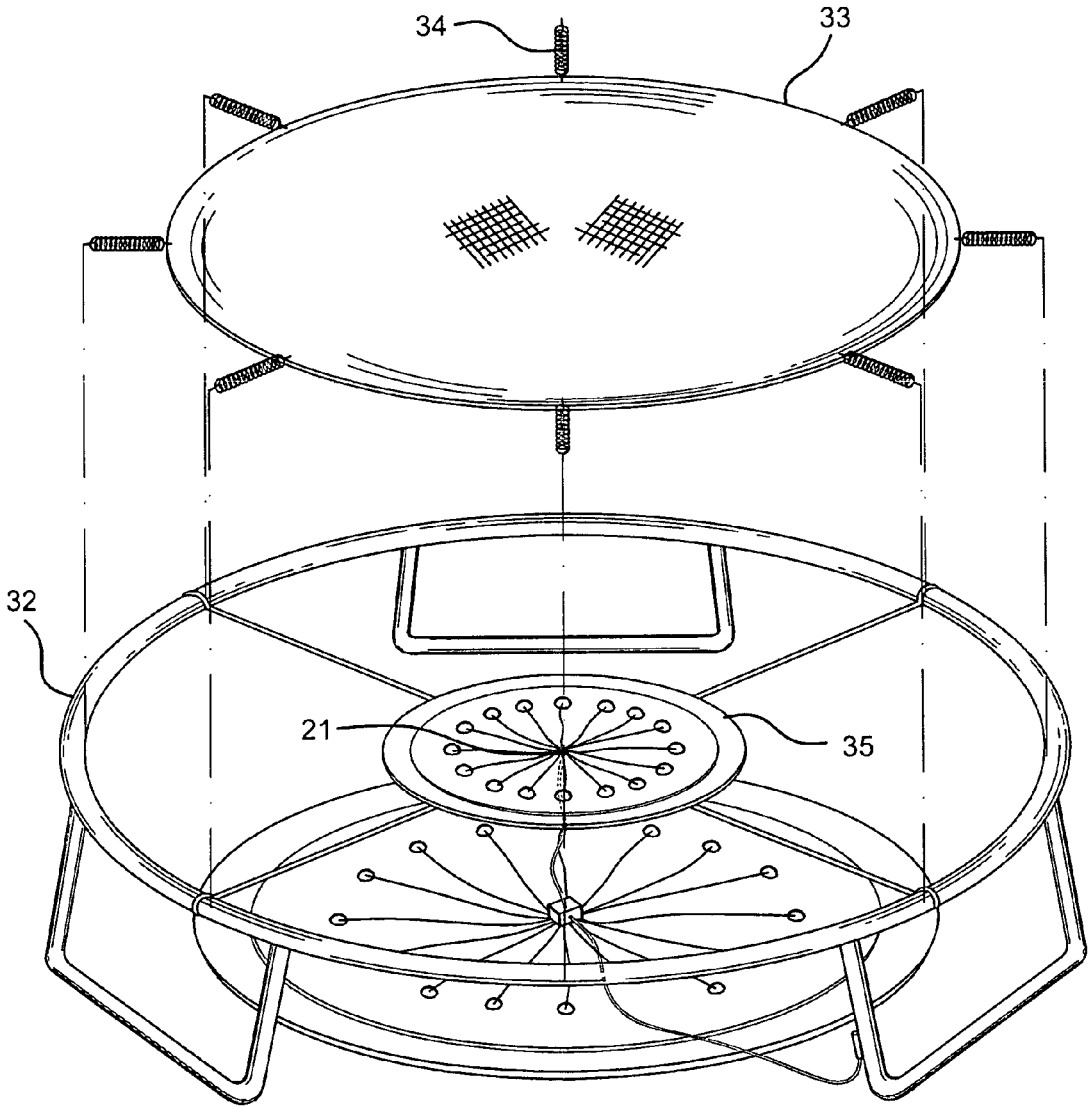
FIG. 5 is a diagram showing installation of the bounce sensor and lighting apparatus.
Figure 6:
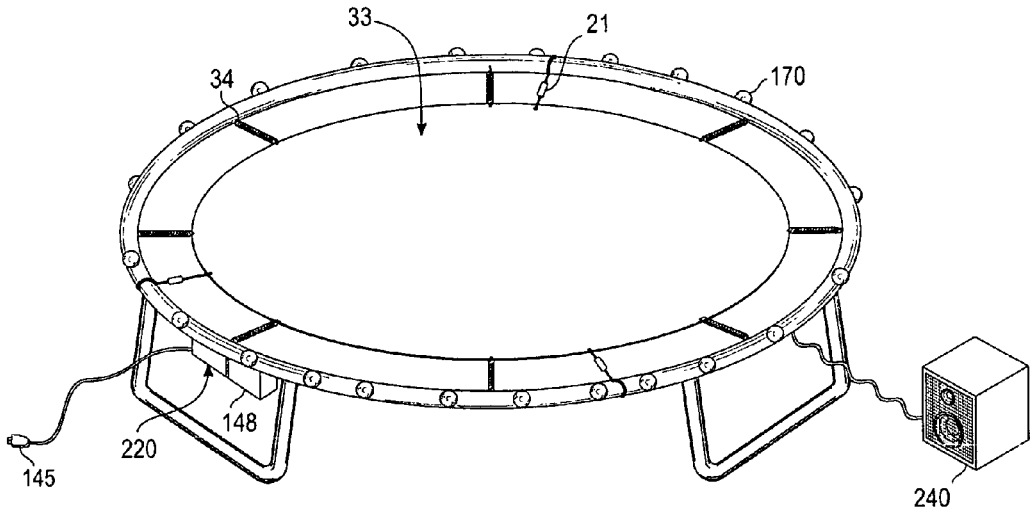
FIG. 6 is a diagram showing installation of lights, bounce sensor, speaker and control housing.
Figure 7:
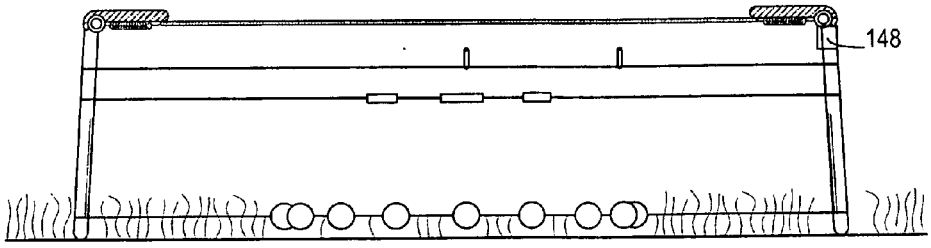
FIG. 7 is a diagram showing installation of the control housing underneath the trampoline frame.

The following callout list of elements can be a useful guide in referencing the elements of the drawings.

21 Bounce Sensor
22 Target
23 Helmet
24 Goggles
25 Mouth
26 Arms
27 Weapon
28 Torso Area
29 Legs
31 Trampoline Poles
32 Trampoline Frame
33 Trampoline Bed
34 Trampoline Spring
41 Gun
42 Strap
43 Trigger
44 Infrared Beam Emitter
45 Bottom Curvature
46 Top Curvature
47 Padded Exterior
48 Trigger Wiring
51 First Target Strap
52 Second Target Strap
53 Infrared Beam
80 Bounce Sensor Housing
81 Sensor Sheath
82 Sensor Flexible Resilient Spring
83 Sensor Post
84 Sensor Base
85 Sensor Spring Wiring
86 Sensor Post Wiring
145 Plug
148 Control Housing
170 Lights
220 Power Supply
240 Speaker

DETAILED DESCRIPTION OF THE PREFERRED EMBODIMENT

A target game can include a bounce sensor 21 which is preferably mounted on the bed of the trampoline or connected to the bed of the trampoline to detect vibrations. The bounce sensor can also be mounted on the springs or toward the edge of the bed. The standard trampoline bed 33 is connected to the trampoline frame 32 at trampoline springs 34. The bounce sensor 21 can be housed within a lighting apparatus formed as a small flexible plastic disk encapsulating LED elements and mounted under the bed. Additional lighting elements can be formed below the small flexible plastic disk. The lighting elements and speaker may activate according to the theme of the target game.

A control housing 148 may contain a microprocessor for controlling game lights 170 and one are more game speakers 240. Preferably, a power supply 220 provides power via household electric current from a plug 145.

A variety of different targets 22 can be connected to trampoline poles 31 at a top of a trampoline pole or at a bottom of a trampoline pole near the bounce surface. The trampoline poles 31 are mounted on trampoline frame members 32. The trampoline frame supports a trampoline bed 33.

The targets can be in the form of a creature such as a soldier having a helmet 23, a pair of goggles 24, a mouth 25, and a pair of arms 26. The target can also have a weapon 27, a torso area 28 and a pair of legs 29. The targets may also have clothing accessories such as shoes.

The targets may have vulnerable areas that transmit an electrical signal when hit by an infrared beam from an infrared emitter shaped as a spherical gun 41. Vulnerable areas are infrared receivers which can be placed on graphical aspects of the targets, such as an oval target mouth 25, or a square torso area 28. The vulnerable areas may be lighted by LED lights so that a participant may see locations to hit.

The bounce surface may interact with the bounce sensor 21 so that a processor alternates or cycles between different areas of the target as vulnerable areas. When a vulnerable area is hit by the user, a light or a sound or both can indicate hit connection. Alternatively, the vulnerable area can be lighted only after a certain number of hits or receive a sound only after certain number of hits.

The bounce surface registers bounces from a user via the bounce sensor. A variety of different patterns of bounce may be required for activating the vulnerable areas on the targets.

A user may begin with a limited character definition lacking in power. For example, the shot rate of the character may only be once per second at a first level and as a user accumulates more points but surely more targets, the user may attain higher levels and have equipment upgrade such that the user may fire more often and have longer bursts of fire. The user may also receive a wider hit dispersion or wider beam weapon angle. The game computer can also allow functionality of a first gun and then a second gun at a later level in the game.

A particular set of characteristics such as fire rate, weapon cooldown and fire length may be associated with different levels. These level characteristics can be input in a microprocessor. The microprocessor can be a computer like system including memory and a power supply.

The player could begin every game at a first level and increase from a first level to a second level, then a third level and then a fourth level until the character reaches a 10th level for example.

The gun is preferably shaped as a ball like sphere having a strap 42 connected to the sphere. The sphere preferably has a loop to fit around a wrist. Additionally, the gun has a bottom curvature 45 preferably formed as a bottom curvature of the sphere. The gun preferably also includes a top curvature 46. The gun has a trigger 43 on a side of the ball and a beam emitter fitted at a tip of the gun. The trigger can be round at a front end and elongated as a button for depressing with a thumb at a thumb position.

When a user does not wish to show that the targets on the top of the trampoline poles, the user may detach the target and hang the target on the netting at a hook 54 that can be located at a helmet portion of the target. The target may have feet on its legs extending horizontally to provide stability on the trampoline bed surface itself Typically, the user may attach the target at using a first target strap 51 or a second target strap 52.

In a simple embodiment of this invention, a game could be played with the following rules embedded into the microprocessor. The player begins at level 1 and has five bounces for each shot. The player must bounce five times to load the gun with one shot. The single shot allows for a 0.1 sec pulse of infrared beam from the gun. After firing, the player must bounce five times to reload the gun again with a second shot. Each target requires one hit to complete such that the target has one hit point and the gun has a damage of one hit point. The target is assigned a certain number of hit points. The game level is level 1 and the player is also level 1. Once the player hits five targets, the player advances to level 2.

At level 2, the player must bounce four bounces to recharge each shot, and the gun ammunition capacity is now increased to two shots with a 1 second cooldown between each shot requiring that the player wait one second before firing the second shot. The targets still require a single shot. The game level is now level 2 and the player is also level 2. After hitting five targets, the player advances to level 3.

At level 3, the player must bounce four bounces to recharge each shot, and the player has three shot capacity for ammunition with a 0.5 sec cooldown between each shot requiring that the player wait 0.5 seconds before firing again. The targets now require two shots to complete because the target now has two hit points and the gun does a damage of one hit point per hit. The game level is now level 3 and the player is also level 3. After hitting six targets, the player advances to level 4.

At level 4, the player must bounce three times to recharge each shot, and the player has a ammunition shot capacity of four. The player has a 0.4 cooldown between each shot requiring that the player wait 0.4 seconds before firing again. The target requires two shots to complete. The game level is now level four and the player is also level four. The targets now regenerate and heal over time by generating at the rate of one hit every three seconds.

At level 5, the player must bounce three times to recharge each shot, and the player has a ammunition shot capacity of five. The player has a 0.4 cooldown between each shot requiring that the player wait 0.4 seconds before firing again. The target requires three shots to complete. The targets now regenerate and heal over time by generating at the rate of one hit every two seconds. The game level is now level 5 and the player is also level 5.

At level 6, the player must bounce three times to recharge each shot, and the player has a ammunition shot capacity of six. The player has a 0.4 cooldown between each shot requiring that the player wait 0.4 seconds before firing again. The target requires three shots to complete. The targets now regenerate and heal over time by generating at the rate of one hit every 1.2 seconds. In addition, a target is now designated as the boss target and the player must defeat the boss to advance to the next round. The boss has a total of six hit points and regenerates at the rate of one hit every second so that the boss regenerates one hit point if the boss is not hit within one second of being hit. Thus, the boss only takes damage when hit on a vulnerable area in rapid succession and the boss is more than twice as difficult to defeat requiring at least six hits, in comparison to the other underling targets requiring only three hits. The boss can be identified by flashing lights in the eyes or by some other visual or audio indicator. The game level is now level 6 and the player is also level 6.

At level 7, the boss acquires a special power of healing his underlings. The boss casts heal every five seconds and heals any random underling of one hit point, effectively undoing a hit made by the player. The underlings may have a chromatic, number display or other color LED indicator to indicate hit-points. Once an underling is considered killed or defeated, the light on the vulnerable area or some other location on the target can be extinguished to show that the target is inactive and out of play. At level 7, the player must bounce only twice to recharge each shot, and the player has a ammunition shot capacity of seven. The player has a 0.3 cooldown between each shot requiring that the player wait 0.3 seconds before firing again. Each target now requires five shots to complete. After passing a level the player can receive a score calculated from a percentage of missed shots to completed shots and a time factor. The game level is now level 7 and the player is also level 7.

At level 8, the rules are the same as level 7 except that the underlings and boss have a stealth feature. During stealth, the underlings and boss cannot be hit. Only one or two underlings or boss at a time is illuminated at random from among the six targets mounted on the trampoline poles. The location of the revealed target is chosen at random and may switch with each bounce, or at irregular intervals or regular intervals such as once per second. The game level is now level 8 and the player is also level 8.

At level 9, the rules are the same as level 8 except that the underlings and boss now shoot back. An infrared emitter located on the target illuminates at random. An infrared receiver on the gun near the infrared emitter can receive a shot. The user is assigned a certain number of hit points. The user's game ends if the user is hit 10 times effectively giving the user 10 hit points and with each hit doing a damage of one hit point. The user may regenerate hits by bouncing on the trampoline mat with each five bounces healing or undoing one hit point of the user.

The above game can be modified according to the theme of the game by modifying various parameters as defined. The game level is a round requiring a complete deactivation of every target including the underling targets and the boss target. The player level is defined to give the player a variety of different attributes. Gun cooldown time is the time that the gun requires for regenerating. The gun ammunition capacity is the number of shots that the gun stores such that when the gun ammunition capacity is zero, the gun does not operate. Target hit points are the number of hit points required to eliminate the target. Player hit points are the number of hit points required to eliminate the player. Charge per bounce is the number of bounces required to load a shot of ammunition. Regeneration over time is the number of target hit points regenerated automatically per second. Boss hit points on the number of hit points required to eliminate the boss. Boss healing is the number of hit points healed each time the boss heals the underlings. Boss heal cool down is the amount of time before the boss can heal again. Stealth pattern is a random or regular pattern defined in the microprocessor for revealing less than all of the targets. A hit point visual indicator is an indication of the number of hit points that a target has. An activity indicator is a visual indication that a target is active and can be hit. The hit point visual indicator may appear in the vulnerable area of the target. For example, if the vulnerable area of the target is the torso, the visual indication can be activated in the torso area.

A player level need not be the same as the game level, and could be less or more depending upon a player score. The game computer could advance the player on a set schedule after the player obtains a certain score from each successful shot, and also possibly from each successful target elimination.

Figure 8:
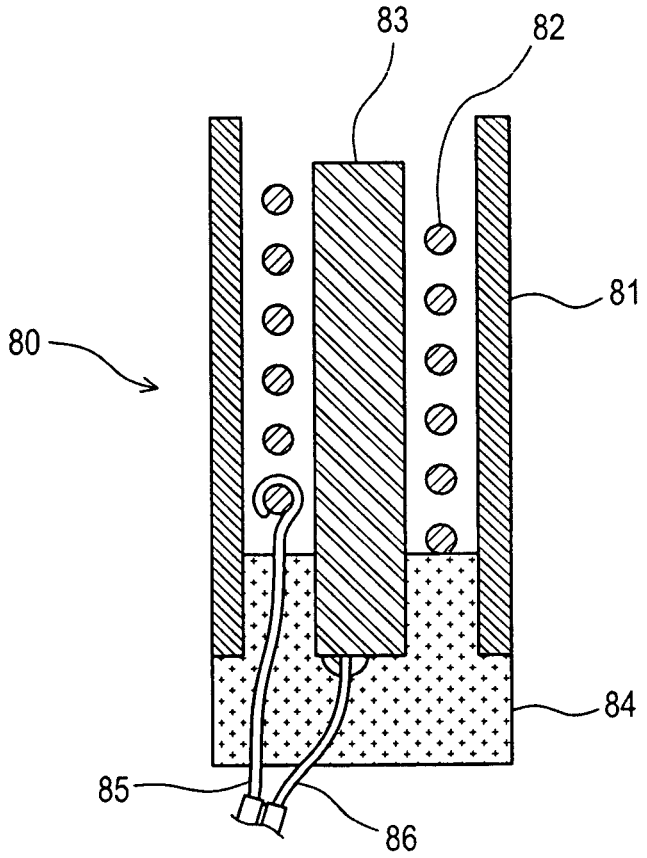
FIG. 8 is a diagram showing the preferred bounce sensor construction.

The bounce sensor is preferably a vibration sensor mounted within a housing. The best mode bounce sensor has a bounce sensor housing 80 in FIG. 8 that includes a flexible resilient spring 82 that touches a post 83 when vibrated, or moved so that it closes a circuit sending a signal to lights connected on the circuit. There is optionally a sheath 81 mounted on a base 84 holding two sets of wiring. The spring wiring 85 connected to the post wiring 86.

Other technical details may include that the microprocessor is stored in the gun. The microprocessor may be mounted in the gun and receive wireless signals from the bounce sensor, and receive and send wireless signals to and from the targets. Therefore, while the presently preferred form of the system has been shown and described, and several modifications thereof discussed, persons skilled in this art will readily appreciate that various additional changes and modifications may be made without departing from the spirit of the invention, as defined and differentiated by the following claims.

The invention claimed is:

1. A trampoline game comprising:

a. a trampoline having a trampoline frame and a trampoline bed, wherein the trampoline bed is connected to the trampoline frame by a plurality of springs;

b. a gun having an infrared emitter emitting an infrared signal; and c. a target having one or more infrared receivers capable of receiving a signal from the infrared emitter of the gun, wherein the target is attached to the trampoline.

2. The trampoline game of claim 1, further comprising: a second gun also having an infrared emitter emitting an infrared signal, wherein the target is capable of receiving an infrared signal from the second gun.

3. The trampoline game of claim 1, further comprising: a bounce sensor for sensing user bounces; wherein the bounce sensor outputs data.

4. The trampoline game of claim 1, further comprising: defined game parameters programmed into a microprocessor that receives data from the target.

5. The trampoline game of claim 4, further comprising: a boss target game parameter and underling target game parameters, wherein the boss target as greater hit points than underling targets.

6. The trampoline game of claim 4, further comprising: a game level game parameter defined as a round requiring a complete deactivation of every target.

7. The trampoline game of claim 4, further comprising: player attribute game parameters comprising: a gun cooldown time defined as a set delay time that the gun requires before a successive shot is initiated.

8. The trampoline game of claim 4, further comprising: player attribute game parameters comprising: a gun ammunition capacity defined as the number of shots that the gun stores such that when the gun ammunition reaches zero the gun can no longer hit targets.

9. The trampoline game of claim 4, further comprising: player attribute game parameters comprising: player hit points defined as a certain number of hit points required to eliminate the player.

10. The trampoline game of claim 4, further comprising: player attribute game parameters comprising: a charge per bounce defined as the number of bounces required to load a shot of ammunition to allow the gun to fire a single shot, wherein the bounce sensor senses the bounces and sends bounce signals to the microprocessor, wherein the microprocessor increments the shot of ammunition.

11. The trampoline game of claim 4, further comprising: a hit point visual indicator located on the target implemented by LED lighting.

12. The trampoline game of claim 1, further comprising: a bounce sensor for sensing user bounces; wherein the bounce sensor outputs data; and further comprising: defined game parameters programmed into a microprocessor that receives data; wherein the bounce sensor outputs data to the microprocessor.

13. The trampoline game of claim 12, further comprising: a boss target game parameter and underling target game parameters, wherein the boss target as greater hit points than underling targets.

14. The trampoline game of claim 12, further comprising: a game level game parameter defined as a round requiring a complete deactivation of every target.

15. The trampoline game of claim 12, further comprising: player attribute game parameters comprising: a gun cooldown time defined as a set delay time that the gun requires before a successive shot is initiated.

16. The trampoline game of claim 12, further comprising: player attribute game parameters comprising: a gun ammunition capacity defined as the number of shots that the gun stores such that when the gun ammunition reaches zero the gun can no longer hit targets.

17. The trampoline game of claim 12, further comprising: player attribute game parameters comprising: player hit points defined as a certain number of hit points required to eliminate the player.

18. The trampoline game of claim 12, further comprising: player attribute game parameters comprising: a charge per bounce defined as the number of bounces required to load a shot of ammunition to allow the gun to fire a single shot, wherein the bounce sensor senses the bounces and sends bounce signals to the microprocessor, wherein the microprocessor increments the shot of ammunition.

19. The trampoline game of claim 12, further comprising: a hit point visual indicator located on the target implemented by LED lighting.

* * * * *